US009115636B2

(12) United States Patent
Allen et al.

(10) Patent No.: US 9,115,636 B2
(45) Date of Patent: Aug. 25, 2015

(54) EVACUATION AND REFILLING DEVICE FOR VEHICLE COOLING SYSTEMS

(75) Inventors: David Mark Allen, St. Louis, MO (US); Scott Allen Sanders, Arnold, MO (US)

(73) Assignee: LINCOLN INDUSTRIAL CORPORATION, St. Louis, MO (US)

( * ) Notice: Subject to any disclaimer, the term of this patent is extended or adjusted under 35 U.S.C. 154(b) by 606 days.

(21) Appl. No.: 13/399,589

(22) Filed: Feb. 17, 2012

(65) Prior Publication Data

US 2013/0213523 A1 Aug. 22, 2013

(51) Int. Cl.
*F01P 11/02* (2006.01)
*F01P 11/06* (2006.01)

(52) U.S. Cl.
CPC ..... *F01P 11/0204* (2013.01); *F01P 2011/065* (2013.01); *Y10T 137/4857* (2015.04); *Y10T 137/877* (2015.04)

(58) Field of Classification Search
CPC . F01P 11/06; F01P 2011/065; F01P 11/0204; F01P 11/0276; Y10T 137/877; Y10T 137/4857; Y10T 137/86493
USPC ..... 141/59, 65, 67, 92, 94, 98, 231; 165/95; 134/169 A
See application file for complete search history.

(56) References Cited

U.S. PATENT DOCUMENTS 4,083,399 A * 4/1978 Babish et al. ..... 165/95
4,127,160 A * 11/1978 Joffe ..... 165/95
4,276,914 A * 7/1981 Albertson ..... 141/92
4,516,603 A * 5/1985 Mock ..... 137/559
4,911,211 A * 3/1990 Andersen ..... 141/7
5,056,621 A 10/1991 Trevino
5,069,062 A * 12/1991 Malecek et al. ..... 73/49.7
5,535,849 A * 7/1996 Few ..... 184/1.5
6,019,145 A * 2/2000 Savidge ..... 141/38
6,257,285 B1 7/2001 Robinson et al.
6,363,977 B1 * 4/2002 Smeller et al. ..... 141/18
6,782,926 B1 8/2004 Hughes
6,886,606 B2 * 5/2005 Few et al. ..... 141/65
6,886,664 B2 * 5/2005 Erwin et al. ..... 184/1.5
7,004,206 B2 * 2/2006 Viken et al. ..... 141/1
7,111,651 B2 * 9/2006 Flynn ..... 141/98
7,137,417 B2 * 11/2006 Kroll et al. ..... 141/66
7,992,600 B2 8/2011 Liu
2004/0079442 A1 * 4/2004 Flynn ..... 141/98
2005/0166993 A1 8/2005 Viken
2006/0042721 A1 * 3/2006 Flynn ..... 141/98
2010/0200109 A1 8/2010 Liao

* cited by examiner

*Primary Examiner* — Timothy L Maust
*Assistant Examiner* — Andrew StClair
(74) *Attorney, Agent, or Firm* — Mark Ussai; SKF USA Inc. Patent Dept.

(57) ABSTRACT

A device for evacuating and filling a vehicle cooling system includes a housing having an interior chamber. A service port extends into the housing and connectable with the vehicle cooling system, a supply port extends into the housing and connectable with a source of coolant fluid, and an evacuation port extends into the housing. A valve is disposed at least partially within the housing chamber and is adjustable between a first configuration in which the service port is fluidly coupled with the evacuation port and a second configuration in which the service port is fluidly coupled with the supply port.

16 Claims, 9 Drawing Sheets

EVACUATION AND REFILLING DEVICE FOR VEHICLE COOLING SYSTEMS

The present invention relates to vehicle service tools or devices, and more particularly to tools/devices for evacuating and refilling a vehicle cooling system.

Tools or devices for evacuating and refilling a vehicle cooling system are known. Certain known devices include a body mountable on an opening of the cooling system (e.g., a radiator opening) and have one or more passages establishing fluid communication between the cooling system opening and one or more ports, the port(s) being connectable with a vacuum generator, a supply of coolant, etc. Typically, one or more valves control flow through the ports. Other devices are generally similar but have a body or housing that is separate or spaced from the vehicle and is connected with the cooling system by a hose or tube.

With either device, the valve(s) is/are typically a two-position valve that either permits or prevents flow through a particular port. As such, an operator must be careful to properly position the valves during evacuating and refilling operations to avoid adverse situations such as a loss of a vacuum prior to refilling the cooling system or spillage of coolant fluid onto the vehicle's engine during the refilling process.

SUMMARY OF THE INVENTION

In one aspect, the present invention is a device for evacuating and filling a vehicle cooling system. The device comprises a service port connectable with the vehicle cooling system, a supply port connectable with a source of coolant fluid, an evacuation port, and a valve coupled with each one of the ports. The valve is adjustable between a first configuration in which the service port is fluidly coupled with the evacuation port and a second configuration in which the service port is fluidly coupled with the supply port.

In another aspect, the present invention is again a device for evacuating and filling a cooling system of a vehicle, the vehicle having a hood. The device comprises a housing configured to be suspended from the hood so as to be spaced generally above the cooling system, the housing having a lower end providing an interface surface facing generally toward the cooling system. A plurality of ports extend through the housing interface surface, the plurality of ports including a service port connectable with the vehicle cooling system, a supply port connectable with a source of coolant fluid and fluidly coupleable with the service port, and an evacuation port fluidly coupleable with the service port.

In a further aspect, the present invention is yet again a device for evacuating and filling a vehicle cooling system. The device comprises a housing having an interior chamber, a service port extending into the housing and connectable with the vehicle cooling system, a supply port extending into the housing and connectable with a source of coolant fluid, and an evacuation port extending into the housing. A valve is disposed at least partially within the housing chamber and adjustable between a first configuration in which the service port is fluidly coupled with the evacuation port and a second configuration in which the service port is fluidly coupled with the supply port.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Certain terminology is used in the following description for convenience only and is not limiting. As used herein, the words "connected" and "coupled" are each intended to include direct connections between two members without any other members interposed therebetween, indirect connections between members in which one or more other members are interposed therebetween, and operative connections in which one member communicates with or affects another member without any direct physical contact. The terminology includes the words specifically mentioned above, derivatives thereof, and words of similar import.

Figure 1:
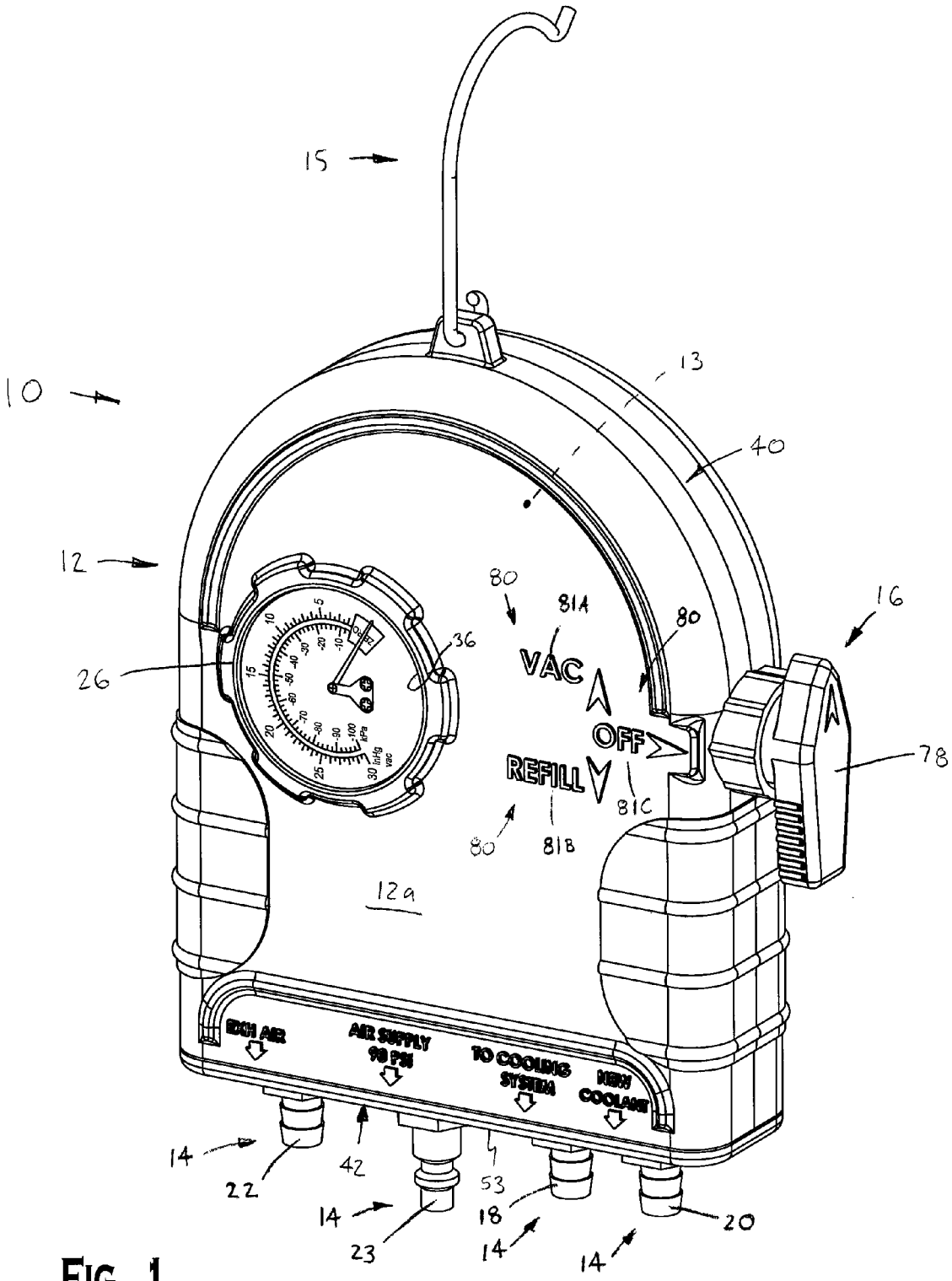
FIG. 1 is front perspective view, taken from the top, of a service device for evacuating and refilling a vehicle cooling system in accordance with the present invention.
Figure 2:
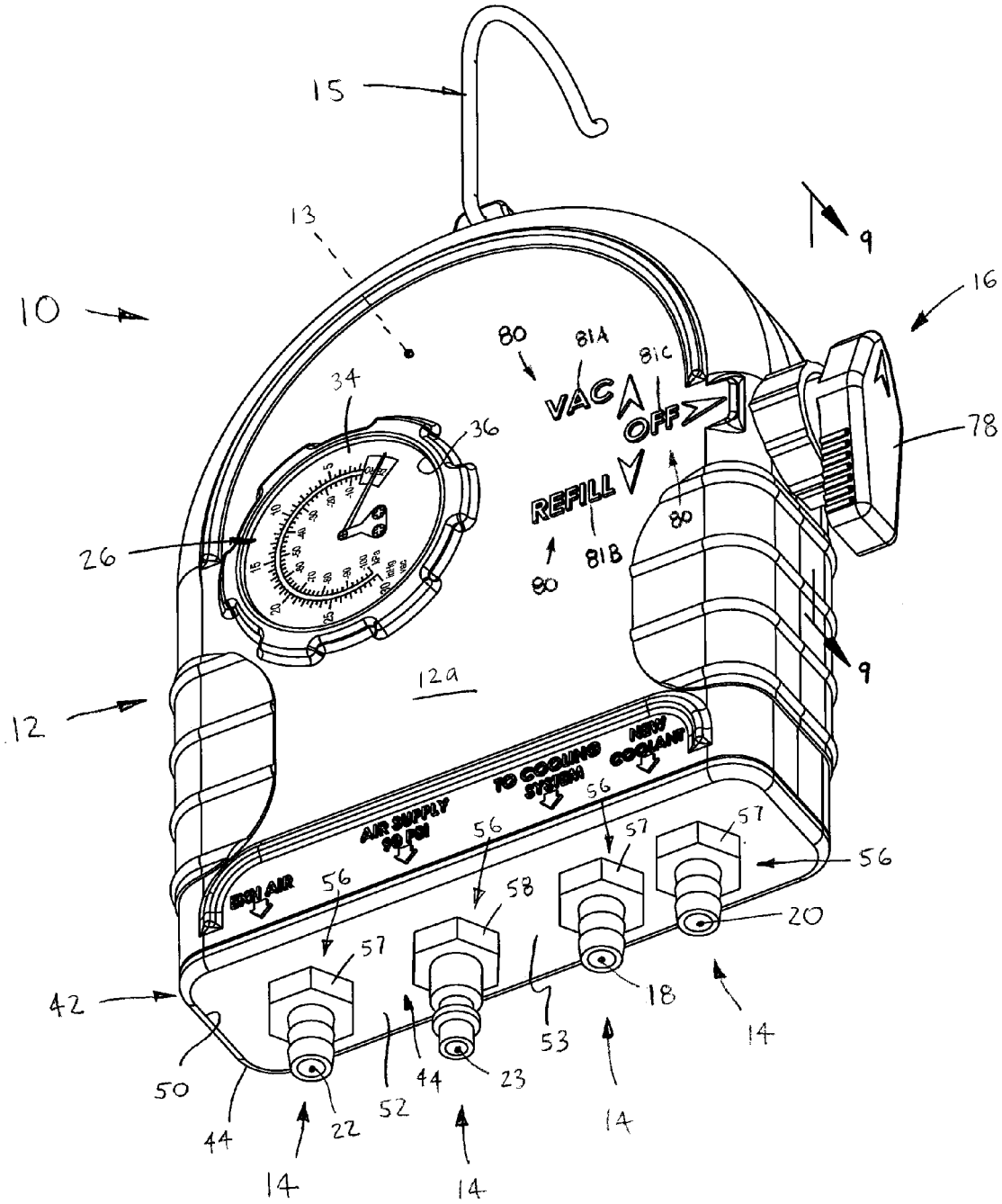
FIG. 2 is front perspective view, taken from the bottom, of the service device.
Figure 3:
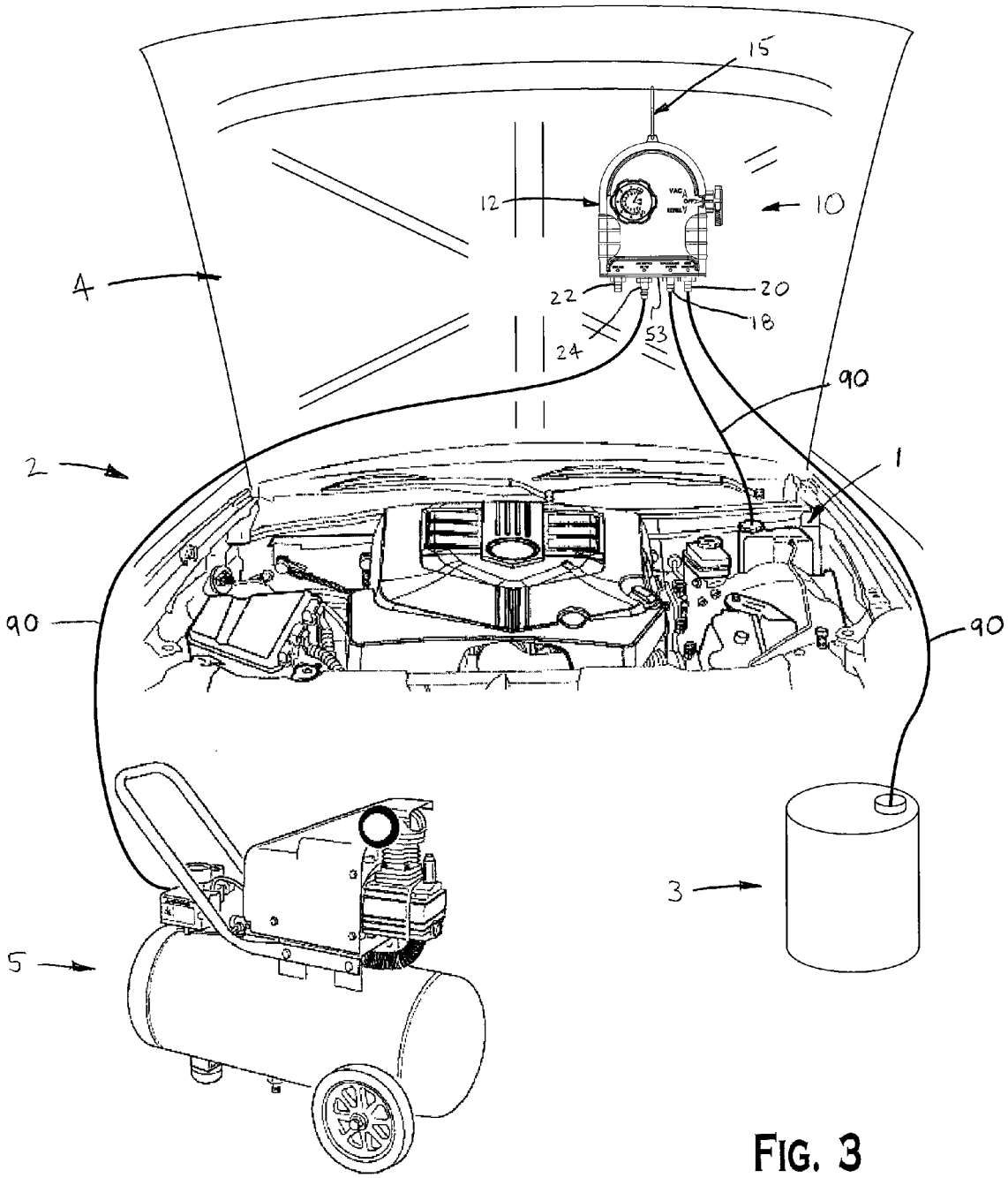
FIG. 3 is a more diagrammatic view of the service device shown in use and connected with the vehicle cooing system, a source of working fluid and a coolant fluid supply.

Referring now to the drawings in detail, wherein like numbers are used to indicate like elements throughout, there is shown in FIGS. 1-9 a service tool or device 10 for evacuating and filling the cooling system 1 of a vehicle 2, the vehicle 2 having a hood 4 (see FIG. 3). Basically, the service device 10 comprises a housing 12 having an interior chamber 13, a plurality of ports 14 extending into the housing 12, and a valve 16 disposed at least partially within the housing 12 and configured to selectively fluidly couple the ports 14. The housing 12 is preferably configured to be suspended from a vehicle hood 4 so as to be spaced generally above the cooling system 1, preferably by means of a hook 15 or other hanging device/means, as discussed below. The plurality of ports 14 preferably include a service port 18 connectable with the vehicle cooling system 1, a supply port 20 connectable with a source of coolant fluid 3, and an evacuation port 22, and most preferably also include a working fluid inlet port 23, as described in detail below.

Further, the valve 16 is fluidly connected with each one of the ports 18, 20, 22 and 23 and is adjustable between a first, "evacuation" configuration $C_1$ (FIG. 6) in which the service port 18 is fluidly coupled with the evacuation port 22 and a second, "refill" configuration $C_2$ (FIG. 8) in which the service port 18 is fluidly coupled with the supply port 20 and the supply port 20 is noncoupled with or disconnected from the evacuation port 22 (i.e., no flow between the ports 20 and 22). Also, the valve 16 is further adjustable to a third, "off" configuration $C_3$ (FIG. 7) in which the service port 18 is fluidly decoupled or isolated from the supply port 20 and from the evacuation port 22 so as to substantially prevent fluid flow into the service port 18 (i.e., through the valve 16). By selectively adjusting the valve 16, an operator is able to perform an evacuation process (FIG. 6) to establish vacuum-like conditions within the cooling system 1, a testing process (FIG. 7) in which pressure in the cooling system 1 is monitored to determine the presence or absence of leaks within the system 1, and a refilling process (FIG. 8) in which new coolant fluid is dispensed into the cooling system 1.

Figure 6:
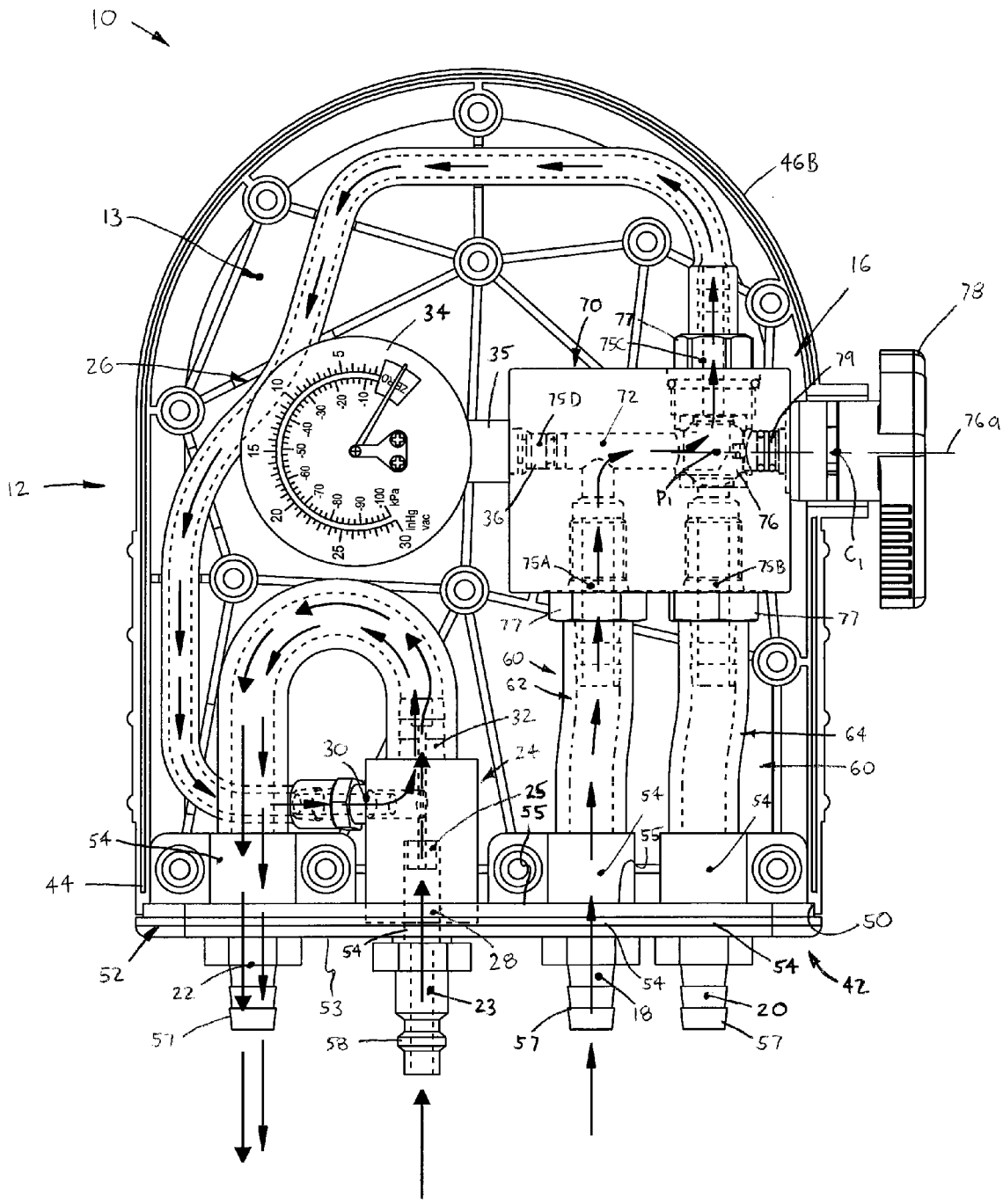
FIG. 6 is a front plan view of the interior of the service device, shown during an evacuation process.
Figure 7:
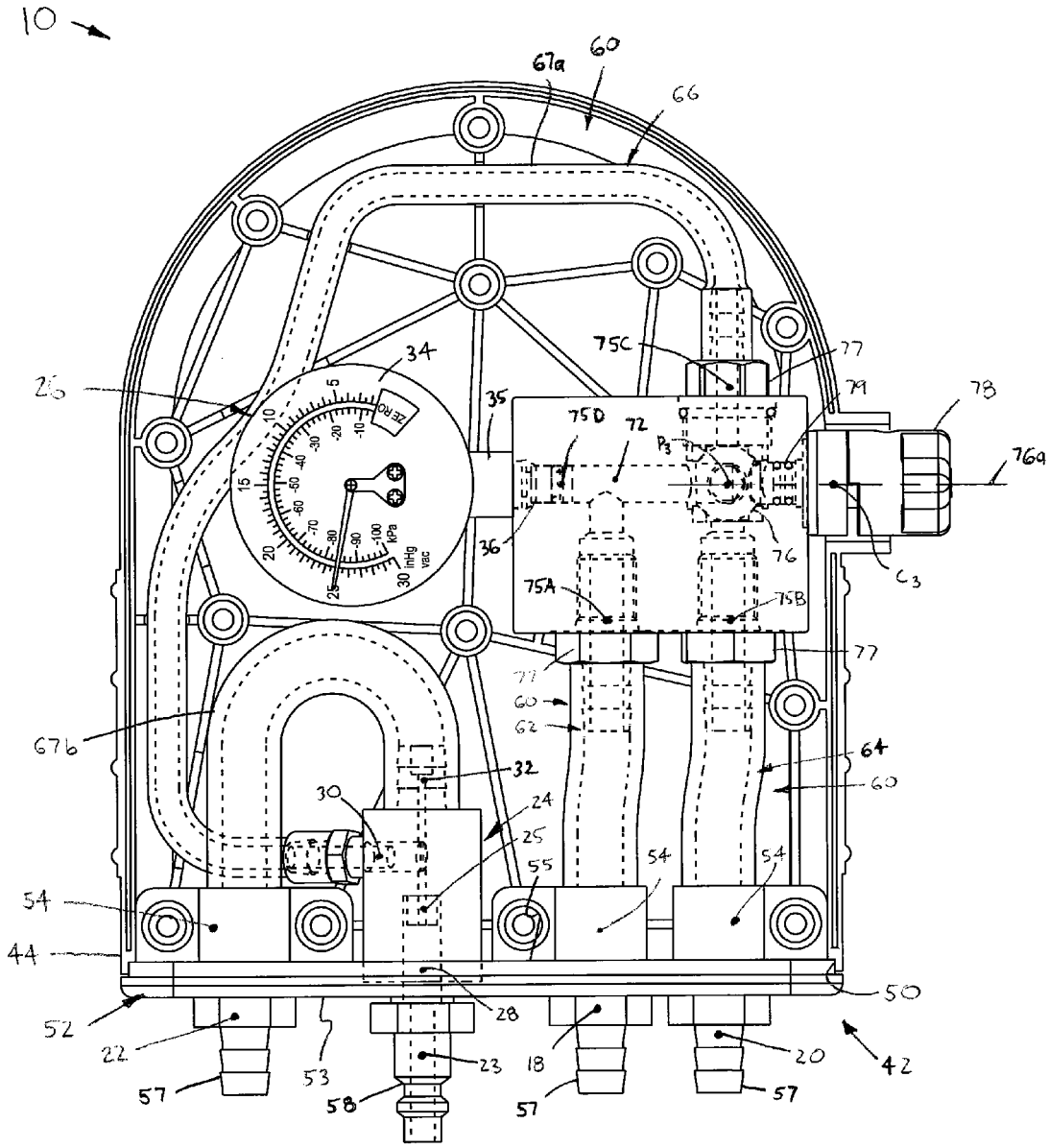
FIG. 7 is another front plan view of the interior of the service device, shown during a leakage testing process.
Figure 8:
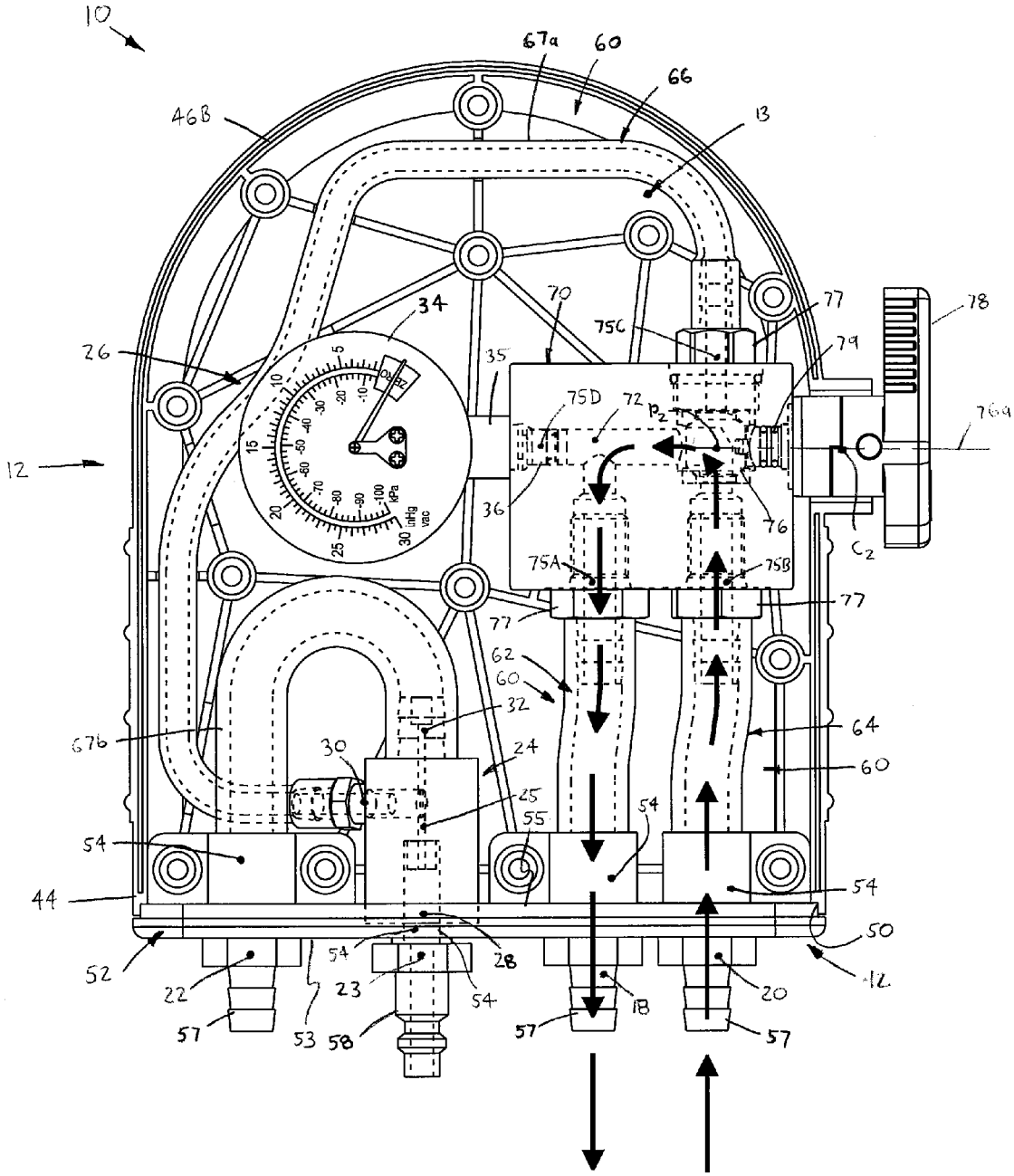
FIG. 8 is another front plan view of the interior of the service device, shown during an refilling process.
Figure 9:
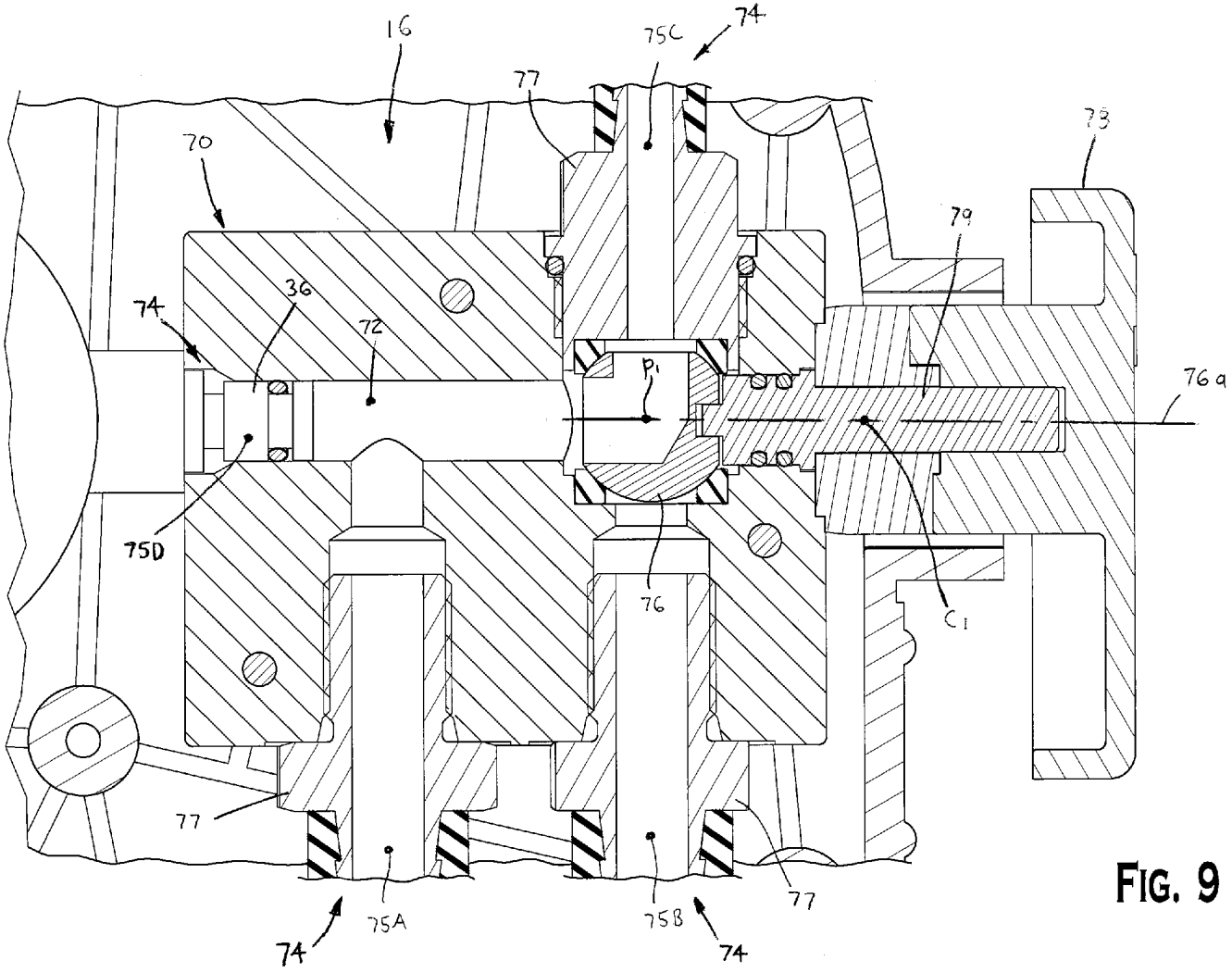
FIG. 9 is a partially broken-away, enlarged cross-section view through line 9-9 of FIG. 2, showing a valve of the service device.

Preferably, the service tool/device 10 further comprises a venturi tube 24 and a pressure gauge 26 each disposed within the housing 12. As best shown in FIGS. 6-8, the venturi tube 24 has a central bore 25 and a plurality of ports extending into the bore 25, specifically a first inlet port 28 connected with the working fluid inlet port 23, so as to thereby be connectable with a source of working fluid 5, preferably compressed air (but may be any other appropriate high pressure fluid), a second inlet port 30 fluidly coupled with the valve 16, and an outlet port 32 coupled with the evacuation port 22. With this structure, fluid is drawn through the service port 18 to evacuate fluid from the cooling system 1 (preferably to establish pressure approximating vacuum conditions) when working fluid/compressed air is directed through the tube inlet port 28 and the valve 16 is arranged in the evacuation configuration $C_1$, as depicted in FIG. 6 and discussed in greater detail below.

Further, the pressure gauge 26 is configured to provide an indication of pressure within the cooling system 1, preferably to monitor that a vacuum is established and maintained within the cooling system 1 to thereby indicate the absence or presence of any leaks within the system 1. Preferably, the pressure gauge 26 has an indicator 34 disposed within (or at least viewable through) an opening 36 in the housing 12 and a body 35 with a stem portion 36 disposed within a gauge port 75D of the valve 16, as described below. The valve gauge port 75D is configured to fluidly couple the pressure gauge 26 with the service port 18 (i.e., through a valve passage 72 as described below) so as to provide an indication or measurement of pressure within the cooling system 1.

Figure 4:
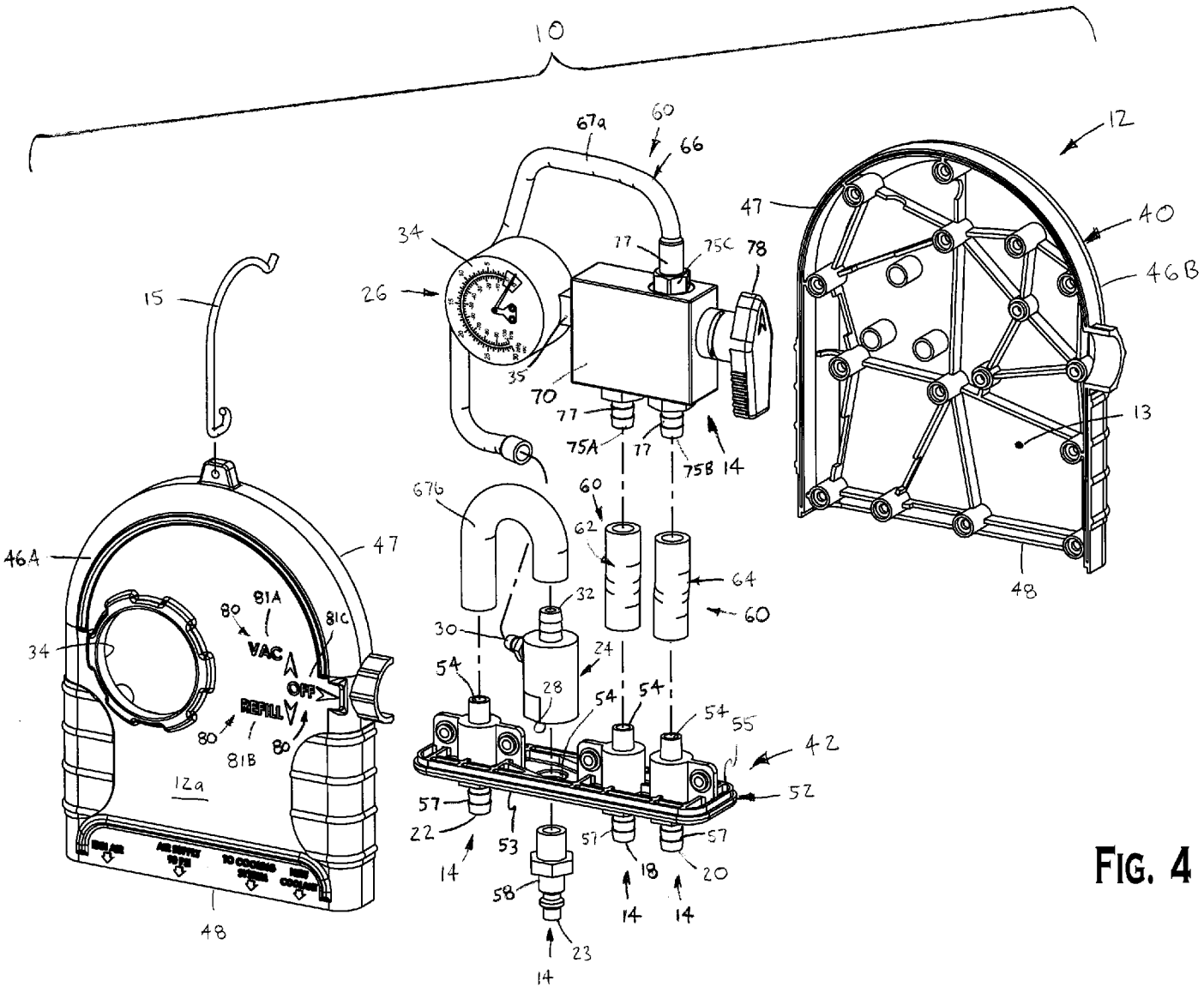
FIG. 4 is an exploded view of the service device.
Figure 5:
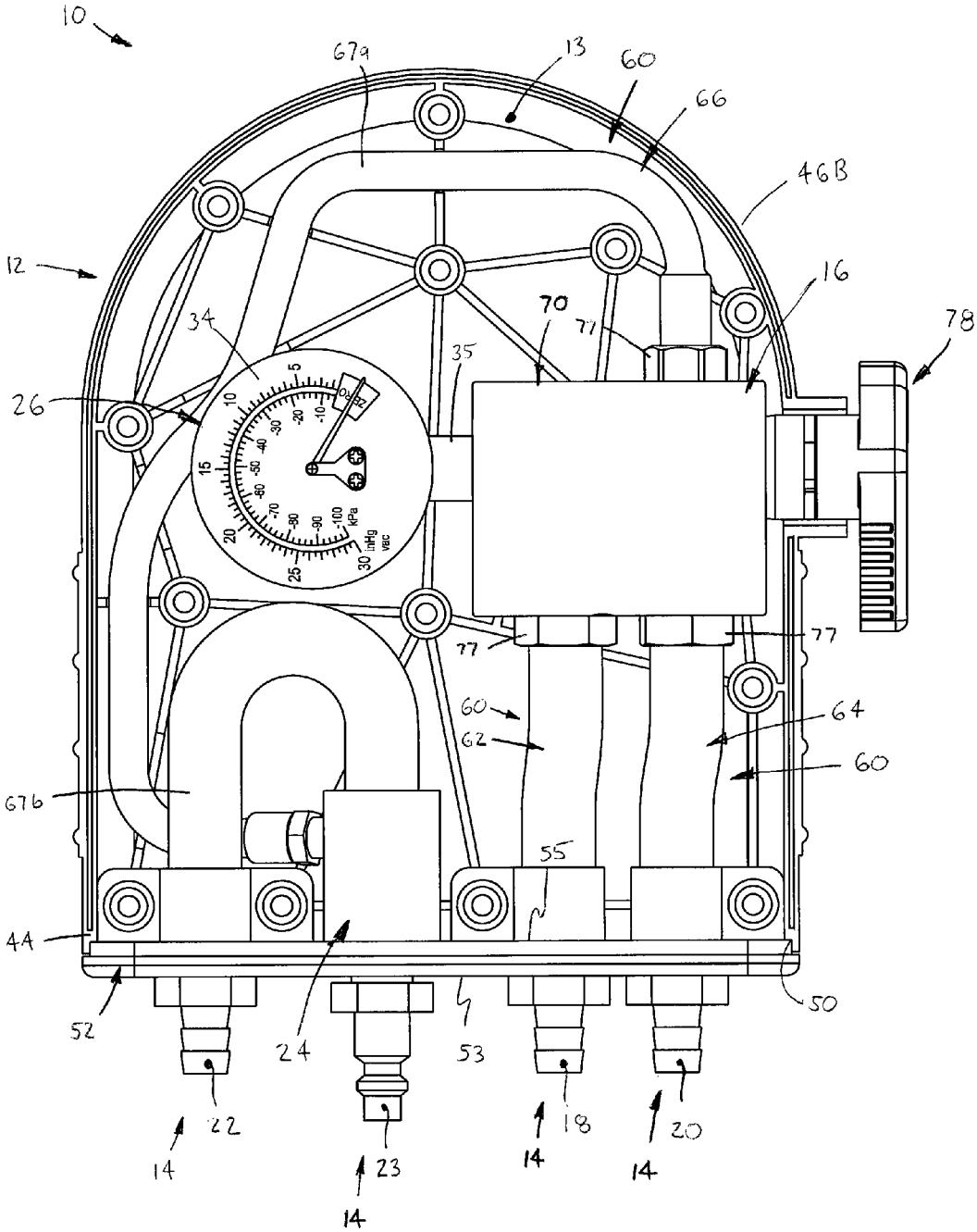
FIG. 5 is a front plan view of the interior of the service device.

Referring to FIGS. 1, 2 and 4, the housing 12 preferably includes a generally hollow shell 40 and a manifold 42 connected with the shell 40 and providing the plurality of ports 14. The shell 40 has a hollow interior providing the chamber 13 and an open end 44 extending into the interior 41. Preferably, the shell includes two shell halves 46A, 46B each formed of a substantially rigid polymeric material (e.g., nylon, Delrin, etc.) and each having a generally U-shaped side edge surface 47 and a generally U-shaped end surface edge 48 (see FIG. 4). The shell halves 46A, 46B are connected to form the housing shell 40, preferably by means of a plurality of threaded fasteners, such that the two side surfaces 47 are generally juxtaposed and the two ends surfaces 48 define a generally rectangular opening 50 at the open end 44. Further, the manifold 42 preferably includes a generally rectangular plate or block 52 formed of a rigid polymeric material and having a plurality of through-holes or passages 54 for the ports 18, 20, 22 and 23, as discussed in greater detail below. The manifold 42 is disposed at least partially within the shell open end 44 to substantially enclose the opening 50 and seal the interior chamber 13.

Furthermore, the manifold block 52 preferably has two opposing faces or end surfaces 53, 55; specifically an exterior, interface surface 53 and an interior surface 55, each one of the ports 18, 20, 22 and 23 extending through the interface surface 53 (and the interior surface 55). When the service device 10 is mounted to the vehicle 2 as intended, i.e., suspended from the vehicle hood 4, the interface surface 53 is spaced from and faces generally toward the cooling system 1. Thus, by locating all of the ports 18, 20, 22, and 23 on a common interface surface 53 that is generally proximal to and faces toward the cooling system 1, the ports 18, 20, 22 and 23 are readily accessible to an operator of the service device 10. Preferably, the manifold 42 further includes a plurality of fittings 56 each disposed within a separate one of the through holes 54. Each fitting 56 includes a central through-passage (not indicated) providing a separate one of the service port 18, the supply port 20, the evacuation port 22 and the working fluid inlet port 23, the three fittings 56 providing the ports 18, 20 and 22 are preferably conventional hose barbs 57 and the fitting 57 providing the working fluid inlet port 23 is preferably a more specialized compressed air fitting 58.

Referring to FIGS. 4-8, the service device 10 preferably further comprises a plurality of fluid lines 60 fluidly connecting or coupling the valve 16 and the various ports 18, 20, 22 and 23, each fluid line 60 being contained substantially within the housing chamber 13. Specifically, a first fluid line 62 fluidly connects the service port 18 with the valve 18, a second fluid line 64 fluidly connects the supply port 20 with the valve 16, and a third fluid line 66 fluidly connects the evacuation port 22 with the valve 16. With the preferred venturi tube 24, the third fluid line 66 preferably includes a first line section 67*a* extending between the valve 16 and the second inlet port 30 of the venturi tube 24 and a second line section 67*b* extending between the outlet port 32 of venturi tube 24 and the evacuation port 22. Thus, the third fluid line 66 fluidly couples all of the valve 16, the venturi tube 24, the working fluid inlet port 23 and the evacuation port 22. Preferably, each of the fluid lines 60 includes a flexible polymeric hose but may alternatively include a generally rigid pipe and/or be formed of another appropriate material such as an elastomer, a rigid polymer (e.g., PVC) or a metallic material (e.g., copper).

Referring now to FIGS. 4-8, the valve 16 is preferably a three-position valve and includes a generally rectangular valve body 70 with a primary flow passage 72, a plurality of ports 74 extending into the body 70 and connected with the primary passage 72, and a closure element 76 disposed within the flow passage 72. The valve ports 74 include a first port 75A fluidly connected with the service port 18, a second port 75B fluidly connected with the supply port 20, a third port 75C fluidly connected with the evacuation port 22 (i.e., through the venturi tube 24), and a fourth or "pressure" port 75D configured to receive the pressure gauge stem portion 36 to fluidly couple the pressure gauge 26 with the service port 18 (and thus the cooling system 1), as described above and in further detail below. Preferably, each valve port 74 is provided by a separate fitting 77 disposed within an opening into the valve body 70, most preferably conventional hose barbs, but may simply be provided by a separate passage/hole extending into the body 70. Further, the closure element 76 is movable, preferably rotatable about a central axis 76*a*, so as to selectively arrange the valve 16 in one of the various configurations $C_1$, $C_2$, $C_3$ in which different combinations of valve ports 74, and thus the device ports 18, 20 and 22, are either fluidly coupled with another port 74 or "noncoupled" (i.e., fluid exchange is prevented) from the other ports 74.

More specifically, in a first position $p_1$ corresponding to the valve evacuation configuration $C_1$ shown in FIG. 6, the closure element 76 permits fluid flow between the first valve port 75A and the third valve port 75C, establishing flow communication between the service and evacuation ports 18, 22, as described in additional detail below. In a second position $p_2$ corresponding to the valve refill configuration $C_2$ as depicted in FIG. 8, the closure element 76 permits fluid flow between the first valve port 75A and the second valve port 75B, thereby enabling fluid flow between the service and supply ports 18, 20, as discussed in further detail below. Further, in a third position $p_3$ of the closure element 76 corresponding to the valve off configuration $C_3$ shown in FIG. 7, the closure element 76 obstructs or prevents fluid flow between the primary valve ports 75A, 75B and 75C. As such, no fluid exchange between any of the device ports 18, 20, 22 can occur through the valve 16, thereby preventing fluid flow into the service port 20 and enabling vacuum-like conditions to be maintained within the cooling system 1, as described below. Preferably, the closure element 76 is a ball with flow passages that are alignable with the primary passage 72 and the various valve ports 74 to establish flow communication therebetween, but may alternatively be a rotatable or linearly displaceable spindle or any other known type of closure element.

Furthermore, the valve 16 preferably includes a manually manipulable handle 78 disposed externally of the housing 12 and a stem 79 disposed partially within the valve passage 72, the stem 79 extending between and connecting the handle 78 and the ball closure element 76. With this structure, an operator may manually rotate the handle 78 about the central axis 76*a* to rotatably displace the closure element 76 between the first, second and third positions $p_1$, $p_2$ and $p_3$, as described above and depicted in FIGS. 6-8. Alternatively, the valve 16 may be provided with automated means to selectively rotate the closure element 76 in response to one or more push buttons or other control device (structure not depicted).

Referring to FIGS. 1 and 2, the housing 12 preferably includes three valve position indicators 80 on the outer surface 12*a* of the housing 12, which each provide a visual indication of a separate one the three positions $p_1$, $p_2$, $p_3$ of the valve closure element 76 when the handle 78 is generally aligned therewith. Preferably, the indicators 80 include an evacuation position indicator 81A with the text "VAC" to indicate the evacuation position $p_1$, a refill indicator 81B with the text "REFILL" indicating refill position $p_2$, and an off position indicator 81C with the text "OFF" to indicate the off position $p_3$. The indicators 81A, 81B, 81C and are preferably molded into the material of the front housing shell half 46A, but may alternatively include any other indicia and/or be attached to or otherwise provided on the housing outer surface 12*a*.

Referring now to FIGS. 3 and 6-8, the service device 10 as described above generally operates in the following manner. When an operator desires to refill a vehicle cooling system 1, the coolant fluid within the system 1 is first drained in an appropriate manner The service device 10 is preferably mounted to the vehicle hood 4 during or after the coolant drain process such that the interface surface 53 is located generally above the cooling system 1. However, the service device 10 may alternatively be rested upon or positioned on an engine component, a portion of the vehicle body, or a separate support device (e.g., a tool cart). Then, the service port 18 is fluidly connected to the cooling system 1 and the working fluid inlet port 23 is fluidly connected with the source of compressed air 5 (e.g., a compressor), preferably by means of a separate flexible tube 90 extending between the particular port 18 or 22 and the cooling system 1 or compressed air source 5, respectively. The valve 16 is then selectively adjusted or arranged in the evacuation configuration $C_1$ shown in FIG. 6, preferably by rotating the handle 78 from alignment with the "OFF" indicator 81C to align with the "VAC" indicator 81A, thereby rotating the closure element 76 from the third position $p_3$ (FIG. 7) to the first position $p_1$ (FIG. 6) to fluidly couple the first and third valve ports 75A, 75C, and thereby the service and evacuation ports 18 and 22.

With the service device 10 arranged as described, compressed air at a relatively high pressure, preferably about ninety pounds per square inch (90 psi), is directed into the working fluid inlet port 23, through the venturi bore 25, and out of the tube outlet port 32 to flow out of housing 12 through the evacuation port 22, which preferably discharges to atmosphere (i.e., the surrounding environment). The high pressure air flow through the tube bore 25 creates a pressure drop at the tube second inlet port 30, which draws fluid from the cooling system 1 to flow into the service port 18, through the valve first port 75A and the valve third port 75C and into the venturi tube second inlet 30, thereafter entraining in the compressed air flow through the venturi bore 25 so as to pass out of the evacuation port 22 and be discharged into the surrounding atmosphere. The process of drawing fluid from the cooling system 1 eventually evacuates substantially all of the air from the system 1, such that pressure within the cooling system 1, as measured in the valve passage 72 fluidly coupled with the cooling system 1, should eventually reach a level approximating a vacuum, for example, about twenty inches of mercury (25 in hg) in the gauge 26.

Then, the valve 16 is adjusted to the third, off configuration $C_3$ (FIG. 7), preferably by rotating the handle 78 from alignment with the "VAC" indicator 81A to align with the "OFF" indicator 81C, thereby rotating the closure element 76 from the first position $p_1$ to the third position $p_3$ to fluidly uncouple or "noncouple" the first and third valve ports 75A, 75C, and thus the service and evacuation ports 18, 22. The operator then performs a "testing" process in which the operator monitors the pressure gauge 26 for a period of time (e.g., 5 minutes) to determine whether the vacuum conditions within the cooling system 1 are maintained; if so, the cooling system 1 is free of leaks and if not, one or more leaks are present in the cooling system 1 and the system 1 must be repaired prior to refilling with coolant fluid.

Once the operator determines that the cooling system 1 is free of leakages, the cooling system 1 may be refilled with coolant fluid by the following process. The supply port 20 is coupled with a source of coolant fluid 3 (e.g., a tank or drum containing the fluid) by means of a tube 90 and then the valve 16 is adjusted from the third, off configuration $C_3$ to the second, refill configuration $C_2$, preferably by manually rotating the handle 78 from alignment with the "OFF" indicator 81C to align with the "REFILL" indicator 81B and thereby rotate the closure element 76 from the third position $p_3$ (FIG. 7) to the second position $p_2$, as shown in FIG. 8. In the second valve configuration $C_2$, the first and second valve ports 75A, 75B are fluidly coupled so as to fluidly couple the service and supply ports 18, 20. Due to the vacuum-like conditions established in the cooling system 1, coolant fluid is drawn out of the coolant supply 3, through the supply port 20 and the second and first valve ports 75B, 75C, and then through the service port 18 so as to flow thereafter into the cooling system 1.

The vacuum-like pressure will continue to draw coolant out of the fluid supply 3 until the cooling system 1 is full, at which point the coolant flow will cease. The valve 16 should then be adjusted to the third, "Off" configuration $C_3$ and thereafter the service port 18 and the supply port 20 may disconnected from the cooling system 1 and coolant supply 3, respectively, and if still connected, the working fluid source 5 may be disconnected from the working fluid inlet port 23. The service device 10 may then be demounted from the vehicle 2, preferably by disengaging the hook 15 from the vehicle roof 4, and is ready for another evacuation and refill operation or for storage.

The service device 10 has a number of advantages over previously known devices for evacuating and/or refilling vehicle cooling systems. The device 10 is lightweight, compact, self-contained and capable of being suspended from the vehicle roof 4 so as to present all required fittings/ports on a single interface surface 53 spaced above the cooling system 1. By having a single, three-position valve 16 as opposed to two or more two-position valves, the valve 16 of the present service device prevents 10 operator error which could lead to a spillage coolant fluid over the vehicle engine. That is, by preventing a fluid connection between the supply port 20 and the evacuation port 22, the device 10 is incapable of drawing fluid from the coolant supply 3 through the valve 16 and out of the evacuation port 22, which could occur if such a fluid connection was established, particularly while compressed air is directed into the venturi tube 24. Such an adverse situation may occur with previously known service/refill devices having a vacuum valve for the evacuation operation and a separate refill valve for the refill operation; specifically, leaving the vacuum valve open while opening the refill valve can lead to coolant flowing out of the vacuum valve and onto vehicle engine instead of flowing into the cooling system 1.

Further, with the three-position valve 16 having an off configuration $C_3$ as described above and shown in FIG. 7, vacuum-like conditions can be maintained within the cooling system 1 for the testing process without potential false readings due to either air flow into the system 1 through an open port (e.g., the supply port 20) or the evacuation of air from the system 1 through the evacuation port 22 due to continued injection of working fluid into the venturi tube 24. Also, due to the separate evacuation port 22 and supply port 20 of the present device 10, there is no need to change attachments that connect with a single port combining these two functions, which avoids the potential loss of vacuum conditions in the cooling system 1. Specifically, certain previously known products having a single port and a single valve require the disconnection of a vacuum attachment from the port and the connection of a refill attachment to the port, during which changeover the vacuum conditions may be lost if the valve is not closed. In fact, with the present service device 10, the connection of the service port 18 with the cooling system 1, the supply port 20 with the coolant supply 3, and the working fluid inlet port 23 with the compressed air source 5 may be established at one time and left connected until both the evacuation and refill operations are complete, thus minimizing the set-up work and eliminating mid-operation changes other than appropriately adjusting the valve 16.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as generally defined in the appended claims.

We claim:

1. A device for evacuating and filling a vehicle cooling system, the device comprising:

a housing having an interior chamber;

a service port extending into the housing and connectable with the vehicle cooling system;

a supply port extending into the housing and connectable with a source of coolant fluid;

an evacuation port extending into the housing;

a valve disposed at least partially within the interior chamber and adjustable between a first configuration in which the service port is fluidly coupled with the evacuation port and a second configuration in which the service port is fluidly coupled with the supply port; and a venturi tube having a first inlet port connectable to a source of compressed fluid and an outlet port coupled with the evacuation port, wherein, in the first configuration, fluid flows from the source of the compressed fluid, through the venturi tube, and out of the evacuation port, thereby drawing a used fluid from the vehicle cooling system, through the service port, through the venturi tube, and out of the evacuation port, and wherein the used fluid remains within the housing between the service port and the evacuation port.

2. The device as recited in claim 1 wherein the valve is further adjustable to a third configuration in which the service port is fluidly decoupled from the supply port and from the evacuation port so as to substantially prevent fluid flow into the service port.

3. The device as recited in claim 1 wherein the housing includes:

a shell having the interior chamber and an open end extending into the interior chamber; and a manifold disposed at least partially within the shell open end and having a plurality of passages, each passage providing a separate one of the service port, the supply port and the evacuation port.

4. The device as recited in claim 3 wherein the manifold has an interface surface spaced from and facing generally toward the vehicle cooling system when the device is mounted to a vehicle, and each one of the service port, the supply port and the evacuation port extend through the interface surface.

5. The device as recited in claim 1 wherein the venturi tube further comprises a second inlet port fluidly coupled with the valve, and wherein the used fluid is entrained in the compressed fluid as the used fluid flows through the venturi tube.

6. The device as recited in claim 5 further comprising a pressure gauge disposed at least partially within the housing and being configured to provide an indication of pressure within the vehicle cooling system.

7. A device for evacuating and filling a vehicle cooling system, the device comprising:

a housing defining an interior volume;

a service port extending into the internal volume and connectable with the vehicle cooling system;

a supply port extending into the internal volume and connectable with a source of coolant fluid;

an evacuation port extending into the internal volume;

a valve positioned in the internal volume and coupled with each one of the service port, the supply port and the evacuation port, the valve being adjustable between a first configuration in which the service port is fluidly coupled with the evacuation port and a second configuration in which the service port is fluidly coupled with the supply port; and a venturi tube positioned in the internal volume and having a first inlet port connectable to a source of compressed fluid and an outlet port coupled with the evacuation port, wherein, in the first configuration, fluid flows from the source of compressed fluid, through the venturi tube, and out of the evacuation port, thereby drawing a used fluid from the vehicle cooling system, through the service port, through the venturi tube, and out of the evacuation port, and wherein the used fluid remains within the housing between the service port and the evacuation port.

8. The device as recited in claim 7 wherein the valve is further adjustable to a third configuration in which the service port is fluidly decoupled from the supply port and from the evacuation port so as to substantially prevent fluid flow into the service port.

9. The device as recited in claim 7 wherein the venturi tube further comprises a second inlet port fluidly coupled with the valve, and wherein the used fluid is entrained in the compressed fluid as the used fluid flows through the venturi tube.

10. The device as recited in claim 7 further comprising a pressure gauge configured to provide an indication of pressure within the cooling system.

11. The device as recited in claim 7 wherein the housing comprises a manifold having a plurality of passages, each passage providing a separate one of the service port, the supply port and the evacuation port, and an interface surface spaced from and facing generally toward the cooling system when the device is mounted to the vehicle, each one of the service port, the supply port and the evacuation port extending through the interface surface.

12. The device as recited in claim 7 wherein the housing includes:

a shell defining the interior volume and an open end extending into the interior volume; and a manifold disposed at least partially within the shell open end and having a plurality of passages, each manifold passage providing a separate one of each one of the service port, the supply port and the evacuation port extending through a separate one of the manifold passages.

13. The device as recited in claim 7 further comprising a first fluid line fluidly connecting the service port with the valve, a second fluid line fluidly connecting the supply port with the valve and a third fluid line fluidly connecting the evacuation port with the valve, each of the first second and third fluid lines being contained substantially within the interior chamber.

14. The device as recited in claim 13 wherein the venturi tube further comprises a second inlet port fluidly coupled with the valve, and wherein the used fluid is entrained in the compressed fluid as the used fluid flows through the venturi tube.

15. The device as recited in claim 7 wherein the housing comprises a hook that is configured to suspend the housing from a vehicle hood so as to be spaced generally above the cooling system.

16. The device as recited in claim 7 wherein the valve includes:

a body with a first inlet port fluidly connected with the service port, a second inlet port fluidly connected with the supply port and an outlet port fluidly connected with the evacuation port; and a closure element movable between a first position in which the service port is fluidly coupled with the evacuation port and a second position in which the service port is fluidly coupled with the supply port.

* * * * *